United States Patent [19]

Quang et al.

[11] 3,999,513

[45] Dec. 28, 1976

[54] DEVICE FOR DEVELOPMENT OF ELECTROPHOTOGRAPHIC ELECTROSENSITIVE PAPERS

[75] Inventors: Pham Kim Quang, Dieppe; Rene Goasdoue, both of Neuville les Dieppe,, France

[73] Assignee: La Cellophane, Paris, France

[22] Filed: Dec. 30, 1974

[21] Appl. No.: 537,600

[30] Foreign Application Data

Nov. 26, 1973 France .....73.42010

[52] U.S. Cl. ..... 118/662

[51] Int. Cl.[2] ..... G03G 15/10

[58] Field of Search ..... 118/637; 427/15; 355/3 P, 10

[56] References Cited

UNITED STATES PATENTS

| | | | |
|---|---|---|---|
| 3,169,887 | 2/1965 | York | 118/637 |
| 3,203,395 | 8/1965 | Liller | 118/637 |
| 3,355,288 | 11/1967 | Matkan | 118/637 |
| 3,367,791 | 2/1968 | Lein | 118/637 |
| 3,415,223 | 12/1968 | Zweig | 118/637 |
| 3,878,816 | 4/1975 | Harris et al. | 118/637 |

*Primary Examiner*—Mervin Stein
*Assistant Examiner*—Douglas Salser
*Attorney, Agent, or Firm*—Sherman & Shalloway

[57] ABSTRACT

A method and an apparatus for the development of electrophotographic or electrosensitive paper comprising a tank having a curved bottom and capable of holding a liquid developer at a constant level; metallic roller means situated in the tank so that the level of developer in the tank is located at a zone wherein the distance between the metallic roller means and the tank wall is the least and does not exceed 5/10mm, a first pair of rollers for feeding said paper into the tank and a second pair of roller means for wiping the papers as they leave the developer and carries them to a receiving point and means for inducing to the metallic roller an electrical potential while grounding tank.

8 Claims, 1 Drawing Figure

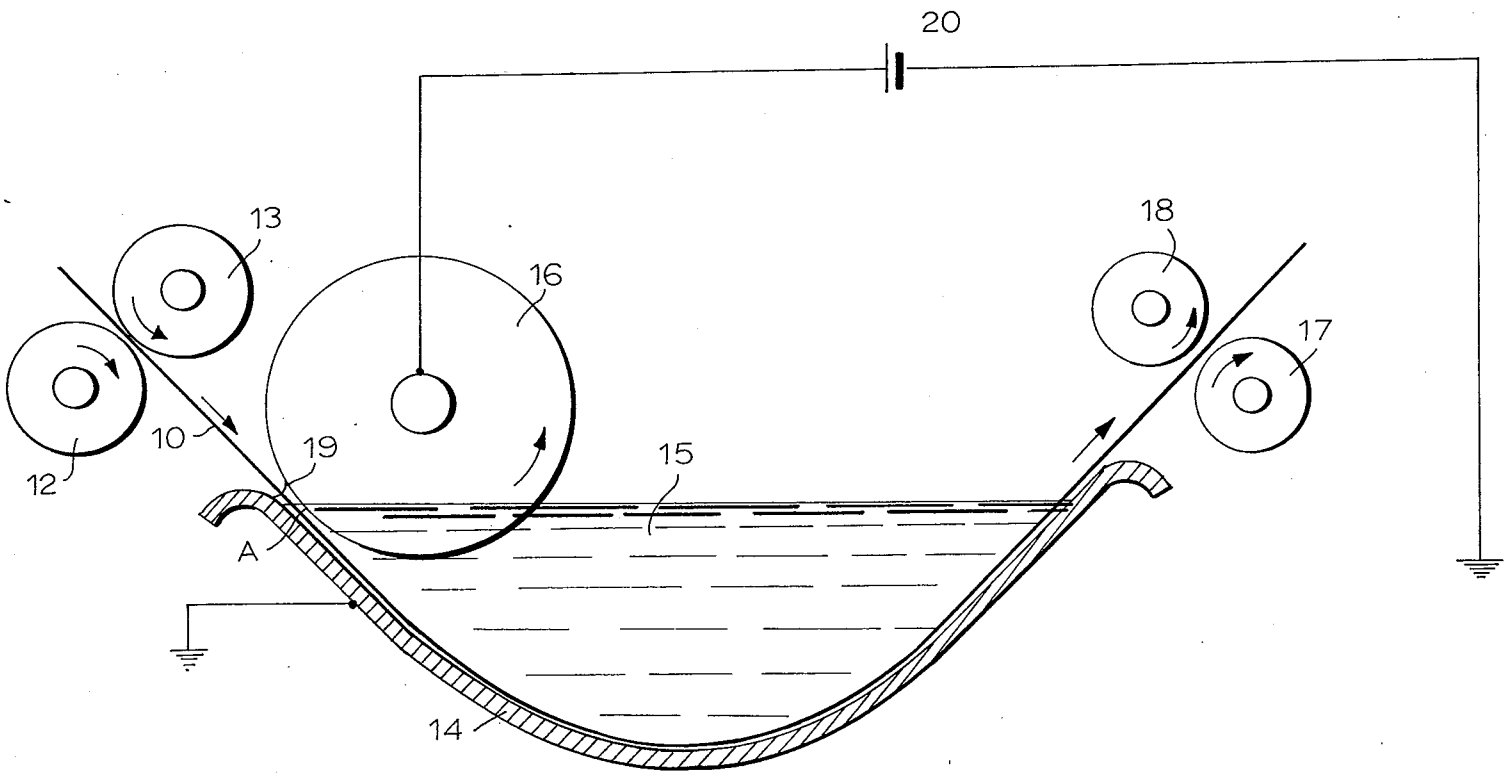
20
18
17
16
15
13
19
A
10
12
14

DEVICE FOR DEVELOPMENT OF ELECTROPHOTOGRAPHIC ELECTROSENSITIVE PAPERS

BACKGROUND OF THE INVENTION

1. Field of the Invention

The present invention pertains to electrophotographic reproduction and, more particularly, to a method and apparatus for uniformly developing a latent charged image carried on pieces of electrophotographic paper in order to evenly distribute the lines of force of the electrostatic field of the latent charged image to eliminate the phenomenon known as the "edge effect."

2. Discussion of the Prior Art

The quality of conventional electrophotographic reproductions, whether developed by powder or liquid toner, is defective due to the phenomenon of "edge effect;" that is, the toner particles are more greatly attracted to the edges of the latent image corresponding to flat tints such that the center portion of the image is developed only faintly. The "edge effect" phenomenon is of only slight consequence in the reproduction of textual material in that the thickening of the edges of developed lines is visible normally only with a magnifying glass; however, the disadvantages of the edge effect phenomenon are extremely noticeable in the electrophotographic reproduction of images having flat tints. The disadvantages caused by the edge effect phenomenon, thus, have greatly retarded the application of electrophotostatic photography within the fields of photographic negative reproduction and reproduction of half-tones or continuous documents or negatives taken through a ruled half-toned screen.

The edge effect phenomenon is caused by an uneven distribution of the lines of force of the electrostatic fields formed by the charges deposited on the image side of electrophotographic paper even if the charges are uniformly distributed. That is, when a latent charged image is formed on electrophotographic paper, even with the charges evenly distributed over the image surface to be developed, the distribution of the lines of force of the electrostatic field formed by the charges is such that the lines of force are denser along the edges of the latent image separating uncharged areas of the paper from adjacent charged areas. Powder or liquid toners are normally composed of colored charged particles of a polarity opposite to the charged polarity of the latent image such that the particles are attracted by the electrostatic field developed by the latent image charges, and since the electrostatic fields are more intense adjacent the edges of the latent image as compared with the center of the latent image when flat tints are being reproduced, a greater quantity of toner will be deposited at the edges of the latent image causing a visibility inequality of optic density. Thus, after development, the edges of the reproduced image will be darker than the central portions.

To overcome the disadvantages caused by the edge effect phenomenon, it has been attempted to equalize or evenly distribute the lines of force of the electrostatic field and, preferably, to make the lines of force perpendicular to the plane of the latent charged image such that the resulting flux is uniform along a distribution of uniform charges thereby permitting the depositing of equal quantities of developer along such uniform charged areas. One attempt to provide such a uniform distribution of lines of force of an electrostatic field has been to immerse a conductor electrode in a developing or toner medium with the electrode connected to a specific electrical potential in order to channel the lines of force. This approach results in a slight improvement of the edge effect; however, the latent charged image on the electrophotographic paper will be discharged at the slightest contact of the electrophotographic paper with the electrode and such contact occurs all too frequently due to the requirement that the electrode be positioned extremely close to the path taken by the electrophotographic paper. To prevent such contact and discharging, it has been proposed to electrically insulate the electrode, for example, by means of nylon threads; however, due to the friction on the sensitive layer of the electrophotographic paper, the nylon threads cause streaks which distort the resulting image.

The wide use at present of processes for electrophotographic reproduction has led to the appearance on the market of a great number of development devices and particularly for the development with liquid developers.

All of the prior art devices do not give entirely satisfactory results and, in particular, French Pat. No. 2,148,835 discloses requirements that must be met by the liquid developers to cause the disappearance of the edge effect. To succeed, it is necessary to make the electrostatic field created in the liquid developer contained on conductive surfaces of fixed potential, parallel to the surface to be developed and at a suitable distance from the latter, while avoiding any contact between the conductive surfaces and the charged face of the electrophotographic paper.

This patent describes a device in which the paper to be developed is in the form of a continuous strip and passes with its back in contact with one of the electrodes, opposite and at some distance from a conductive roller which, bathing in the liquid developer and turning at a suitable speed, causes the formation of a meniscus at the surface of the passing paper. The device thus described has the drawback of making the paper pass with the photosensitive face turned downward and is not suitable for development of electrophotographic papers previously cut in sizes.

U.S. Pat. No. 3,367,791 of Lein provides a roller dipping into a liquid bath, which roller is operated at speeds such that a hydrodynamic pressure is created against the surface of the sheet, holding the latter against a back guide which is located at a fixed, determinate spacing from the closest point of roller approach. The roller is made conductive, or at least has a highly conductive surface layer, which provides the field control effect required at the point where electrostatic deposit of particles is occurring. The motion of the roller in addition to providing the hydrodynamic forces for sheet control, also renders the liquid action sufficiently turbulent to provide a constant changing and replenishing action which will forestall the possibility of the developing liquid's reaching a starved or depleted condition at the developing location where rapid particle deposit is occurring due to the presence of the highly efficient field control.

There are other prior art devices which have tried in order to make improvements which make it possible to assure sheet by sheet development and having the conductive face turned upward, however, these devices either do not assure development of such quality as to eliminate the edge effect phenomenon or else require complicated guiding means.

SUMMARY OF THE INVENTION

The improvement in the development devices which is the object of the present invention makes it possible to assure sheet by sheet development of electrophotographic papers, having the photoconductive face turned upward, at the same time permits the development to take place by the sufficiently prolonged action of a constantly renewed and enriched liquid developer under the action of a suitably arranged electric field. In this way, the improved devices according to this invention make it possible to assure an excellent development at speeds reaching 20 to 25 meters/minute which is very superior to those which can now be offered and which do not exceed about 10 meters/minute.

The devices according to the present invention are characterized in that the electrophotographic paper to be developed is introduced into a conductive support such as a tank with a curved bottom so that it penetrates into the liquid developer contained in this tank opposite an electrically conductive roller such as metallic roller which may or may not be turning, placed some tenths of a millimeter from the wall of the tank, the level of the developer in the tank being located in the zone where the distance between the roller and the tank wall is the least. This distance should preferably be less than 5/10 mm; it is generally set between 2/10 and 4/10 mm, as a function of the thickness of the paper used. The paper may be such as disclosed in U.S. Pat. No. 3,367,791.

It was found that the electrophotographic paper which goes into the developer, the back side in contact with the tank wall, stays applied to this wall because of a suction effect probably due to a capillary phenomena, during its entire travel in a state of immersion in the tank without its front side ever coming in contact with the metallic roll.

The metallic roller and tank wall, which are also preferably of metal, can be brought to suitable potentials to assure a development free of any edge effect.

The metallic roller forming the electrode can be driven in a rotation movement that assures the formation of a meniscus which constantly fed with fresh developer, thus assuring a well contrasted development without edge effect.

Feeding of the developer to the development tank is preferably performed continuously with an evacuation orifice, which assures a constant level, being placed at the desired height.

The paper to be developed is introduced tangentially to the tank wall by passing it between two rollers of insulating material of the same diameter and turning at the same speed.

After development at the outlet of the tank, it is again taken up between two other rolls turning at the same peripheral speed as the introduction rolls. Any size of length greater than or equal to that of the path which, fitting the bottom of the tank, connects the point of tangency of the two pairs of rolls, can thus be developed.

BRIEF DESCRIPTION OF THE DRAWING

For a fuller understanding of the nature and objects of the invention, reference should be had to the following description taken in connection with the accompanying drawing, in which:

The FIGURE schematically illustrates an apparatus for the development of electrophotographic papers in accordance with this invention.

DETAILED DESCRIPTION OF THE INVENTION

As seen in the drawing, a piece of electrophotographic paper 10, covered on its upper face with an image of charges is driven between the two rolls of insulating material 12 and 13 and goes into a tank 14 which contains a toner or liquid developer 15, tangentially to the wall of the tank in which the developer level is maintained constant by an overflow (not shown) so that point A where the electrophotographic paper goes into the developer is opposite metallic roller 16 at the place where the surface of the latter is closest to the tank wall, at a distance not exceeding 5/10 mm.

Moved by the rollers 12 and 13, the sheet of electrophotographic paper 10 advances without its back side ceasing to be in contact with the tank wall so that as it leaves the tank, it is grasped between turning rollers 17 and 18 which wipe it off and is carried toward a receiving point (not shown).

Roller 16 is driven by a movement turning in the direction of the arrow so that there is formed in the vicinity of point A a meniscus 19 which is constantly fed with fresh developer.

Metallic roll 16 is brought to a suitable potential by a variable voltage generator 20 while tank 14, which is also metallic, is grounded so as to make it possible to create in the vicinity of point A an electric field of suitable sign and value, directed perpendicularly to A to the sheet of electrophotographic paper and thus to assure a good quality development of the image of charges, the suitable choice of potential making it possible to avoid the appearance of marks on the back of the copy paper. It will be appreciated that in the instant specification only a particular embodiment has been used to illustrate the same. The invention, however, is not limited to this specific embodiment. In view of the foregoing disclosure, variations and modifications thereof will be apparent, and it is intended to include within the invention all such variations and modifications.

What we claim:

1. An apparatus for the development of electrophotographic or electrosensitive paper comprising a tank having a curved bottom and capable of holding liquid developer at a constant level;

a metallic roller means placed in the vicinity of the tank wall, said roller means being parallel to said tank wall without contact and being capable of being brought to a predetermined electrical potential;

means for bringing said metallic roller means to a predetermined electrical potential;

a first pair of turning rollers for introducing into said tank the papers to be developed between the wall of said tank and said metallic roller means; and a second pair of rollers having the same diameter as said first pair of rollers and capable of turning at the same speed, said second pair of rollers contacting said pieces of paper so as to wipe them off when leaving the developer whereby the level of the developer in the tank being located in a zone where the distance between the metallic roller means and the tank wall is the least and does not exceed 5/10 mm.

2. The apparatus of claim 1 wherein said the metallic roller means is driven in a continuous movement of rotation.

3. The apparatus of claim 1 wherein said tank that contains the liquid developer is made up of a material conductive of electricity.

4. The apparatus of claim 1 wherein said metallic roller means forms an electrode.

5. The apparatus of claim 1 wherein the tank wall is metallic.

6. The apparatus of claim 1 including means for inducing a variable electrical potential to said metallic roller means.

7. The apparatus of claim 1 wherein said zone distance is between 2/10 and 4/10 mm.

8. The apparatus of claim 1 wherein said first pair of rollers are of insulating material.

* * * * *